US006379288B1

(12) United States Patent
Liu

(10) Patent No.: US 6,379,288 B1
(45) Date of Patent: Apr. 30, 2002

(54) VARIABLY-WEIGHTED EXERCISE HOOP

(76) Inventor: Chi-Chang Liu, No. 17, Alley 46, Lane 484, Sec. 2, Feng-Shih Rd., Fengyuan City, Taichung Hsien (TW)

( * ) Notice: Subject to any disclaimer, the term of this patent is extended or adjusted under 35 U.S.C. 154(b) by 0 days.

(21) Appl. No.: 09/420,135

(22) Filed: Oct. 18, 1999

(51) Int. Cl.[7] ..... A63B 21/065

(52) U.S. Cl. ..... 482/105; 482/93; 482/110; 482/131; 446/236

(58) Field of Search ..... 482/44, 92, 93, 482/105, 106, 110, 108, 131, 132, 148, 94, 98, 99; 446/26–28, 236, 419, 421, 490; 601/132, 131, 118; 405/186, 187; 473/594; 273/DIG. 19, DIG. 20

(56) References Cited

U.S. PATENT DOCUMENTS

| | | | | | |
|---|---|---|---|---|---|
| 1,177,505 | A | * | 3/1916 | Fleming | 403/182 |
| 1,190,831 | A | * | 7/1916 | Werner | 607/149 |
| 1,245,965 | A | * | 11/1917 | Pratt | 63/38 |
| 1,702,991 | A | * | 2/1929 | Bechman | 601/132 |
| 3,554,542 | A | | 1/1971 | Span | 273/DIG. 19 |
| 4,090,705 | A | | 5/1978 | Young | 482/82 |
| 4,113,257 | A | | 9/1978 | Moffatt | 473/143 |
| 4,602,784 | A | | 7/1986 | Budden et al. | 482/105 |
| 4,735,413 | A | | 4/1988 | Yamanouchi et al. | 473/426 |
| 5,222,929 | A | * | 6/1993 | Duda | 482/110 |
| 5,492,526 | A | | 2/1996 | Chen | 601/132 |
| 5,531,665 | A | | 7/1996 | Chen | 601/118 |
| 5,779,652 | A | * | 7/1998 | Mencher-Aliazzo | 601/132 |
| 6,056,621 | A | | 5/2000 | Lin | 446/236 |
| 6,102,769 | A | | 8/2000 | Huang | 446/236 |
| 6,109,999 | A | | 8/2000 | Kuo | 446/236 |

* cited by examiner

*Primary Examiner*—Mickey Yu
*Assistant Examiner*—Victor Hwang
(74) *Attorney, Agent, or Firm*—Kolisch Hartwell Dickinson McCormack & Heuser

(57) ABSTRACT

A variably-weighted exercise hoop includes a plurality of large hollow balls, a plurality of plugs corresponding to and received in the balls, and a cable extending through and securing together the combined balls and plugs. A fixed quantity of pellets is enclosed in each combined ball and plug, and that quantity is varied by the manufacturer to achieve hoops of different weights using only one mold, whereby users of different abilities can have suitable hoops. The pellets provide both audible and physical rhythms for a user as the hoop rotates.

4 Claims, 6 Drawing Sheets

VARIABLY-WEIGHTED EXERCISE HOOP

BACKGROUND OF THE INVENTION

1. Field of the Invention

The present invention relates to an exercise hoop, and more specifically to an exercise hoop which is inexpensive to manufacture, is variably weighted, and provides a user both audible and physical rhythms.

2. Description of Related Art

Exercise hoops, such as hula hoops, have been popular for many years as they provide interesting and effective ways to exercise muscles of the waist. A conventional exercise hoop shown in FIG. 6 comprises a plurality of large solid balls, a plurality of small solid balls, and a cord. The large and small balls each define a bore through which the cord extends and are alternately disposed thereon. However, two respective molds are required to produce the large and small balls which pushes up the cost of the hoop. Furthermore, the weights of the large and small balls are fixed, thereby limiting the range of hoops available to users. That is, a beginner in using such a hoop may require a first weight. Then later, after acquiring a degree of skill, the user requires a second weight. Finally, after becoming an expert in using the hoop, the user will need a third weight hoop. The multiple molds required to produce the different weights of large and small balls further add to the manufacturing, cost of the hoops. It is also found that the solid large and small balls lack stimulating rhythm both in sound and motion Therefore, it is an objective of the present invention to provide a variably weighted exercise hoop to mitigate and/or obviate the aforementioned problems.

SUMMARY OF THE INVENTION

The objective of the present invention is to provide a variably weighted exercise hoop comprising a plurality of hollow large balls, a plurality of plugs respectively inserted in the periphery of the balls, and a cord extending through the combined balls and plugs. Each ball contains therein a fixed weight of pellets which permits the overall weight of the exercise hoop to be varied by the manufacturer so as to meet different demands of customers. The pellets are sealed in the balls by the plugs, and provide audible and physical rhythms for a user as the hoop rotates.

Other objects, advantages and novel features of the invention will become more apparent from the following detailed description when taken alone or in conjunction with the accompanying drawings.

DETAILED DESCRIPTION OF THE PRESENT INVENTION

Figure 1:
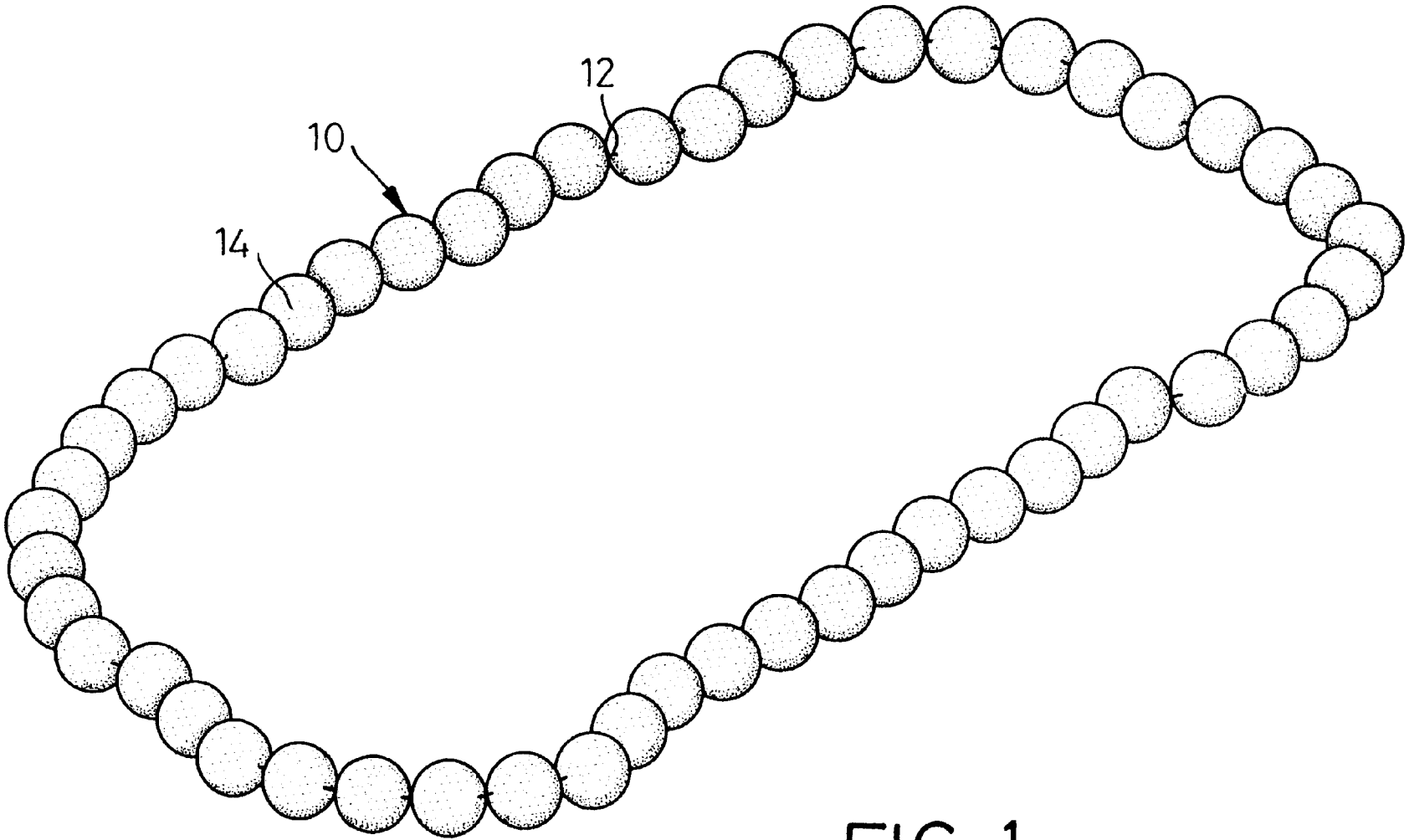
FIG. 1 is a perspective view of an exercise hoop in accordance with the present invention.
Figure 2:
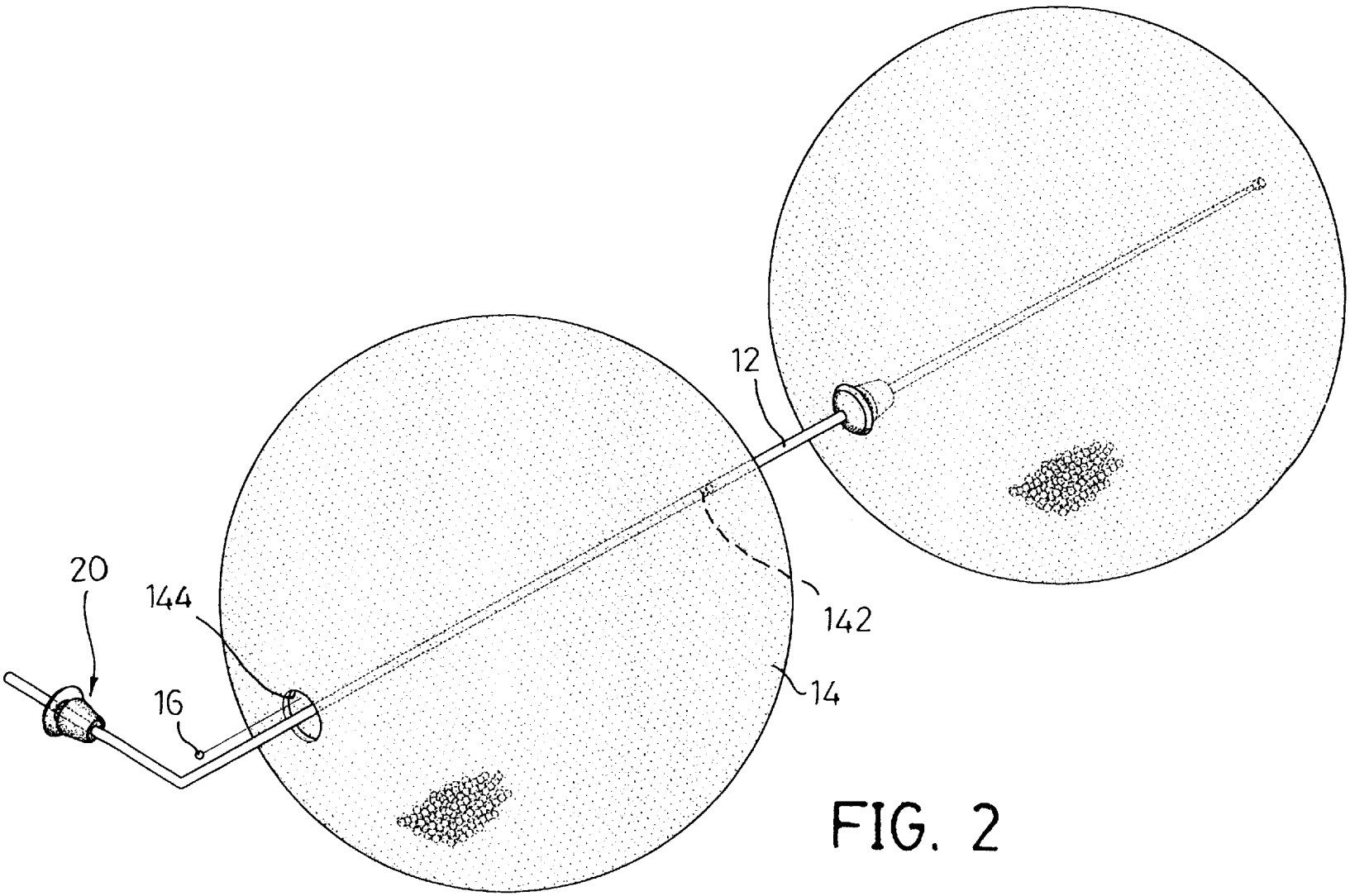
FIG. 2 is a perspective view of part of the exercise hoop in accordance with the present invention.

Referring to the figures and particularly FIGS. 1 and 2, a variably weighted exercise hoop (10) of the invention comprises a plurality of hollow balls (14), a cord (12) and a plurality of plugs (20) each corresponding to one of the plurality of balls (14). Each ball (14) has a first opening (142) and a second opening (144) diametrically opposite to the first opening (142). The first opening (142) has a diameter nominally the same as the diameter of the cord (12). The second opening (144) has a diameter larger than the diameter of the cord (12), and is large enough for a quantity of pellets (16) to be poured into the ball (14).

Figure 3:
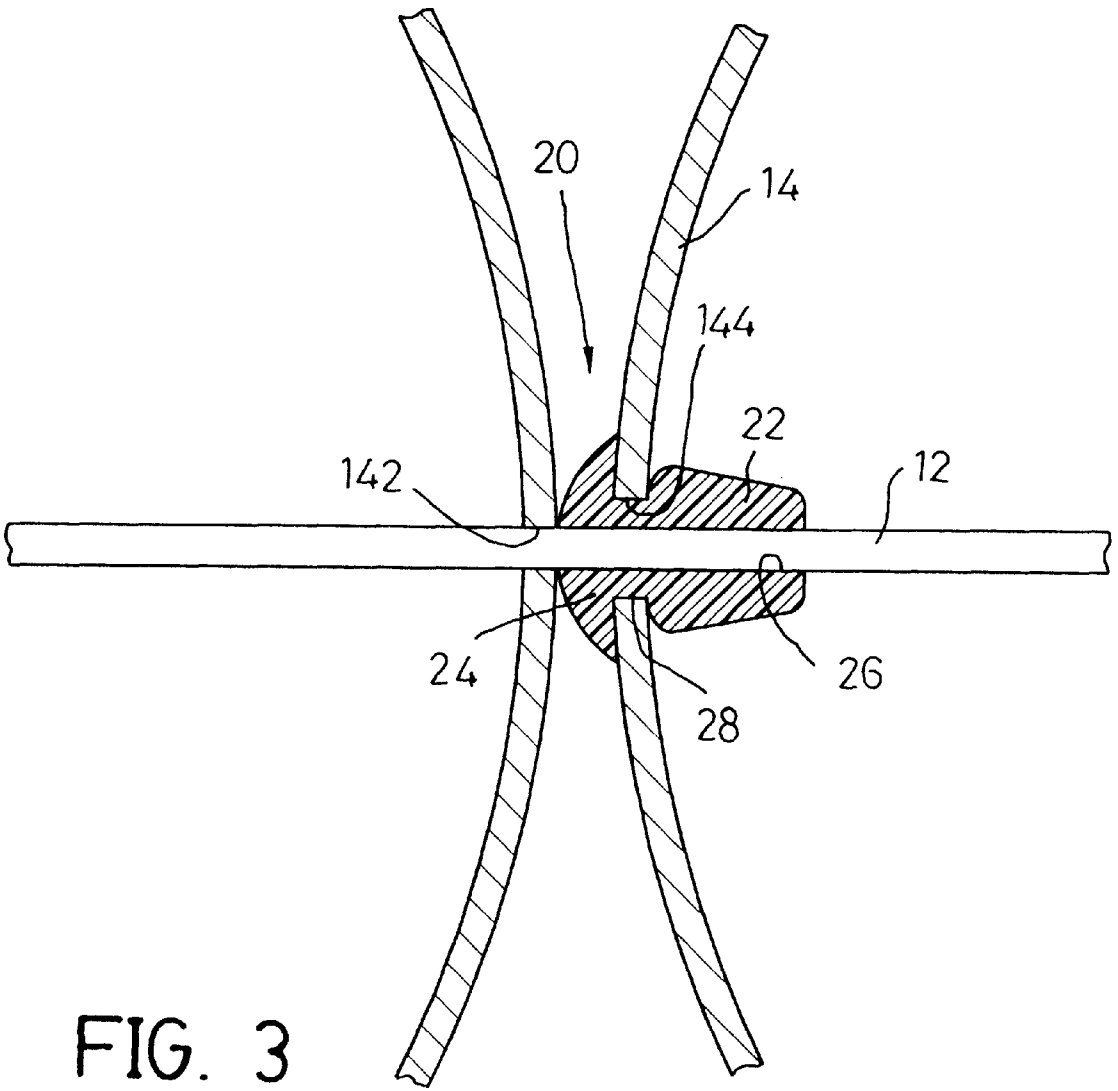
FIG. 3 is a cross-sectional view of a first embodiment showing the configuration of a plug between two balls of the exercise hoop in accordance with the present invention.
Figure 4:
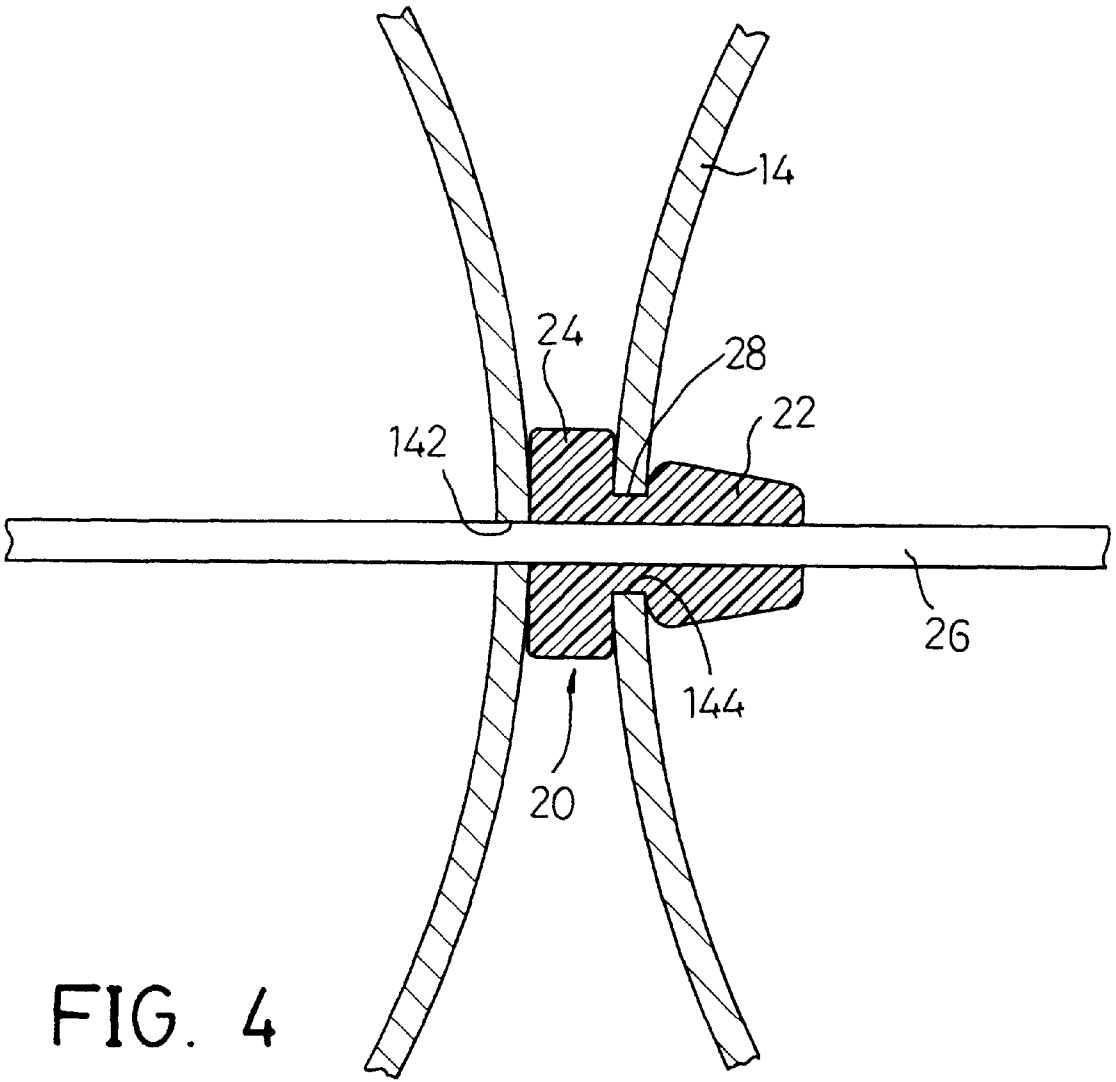
FIG. 4 is a cross-sectional view of a second embodiment showing the configuration of the plug between two balls of the exercise hoop in accordance with the present invention.
Figure 5:
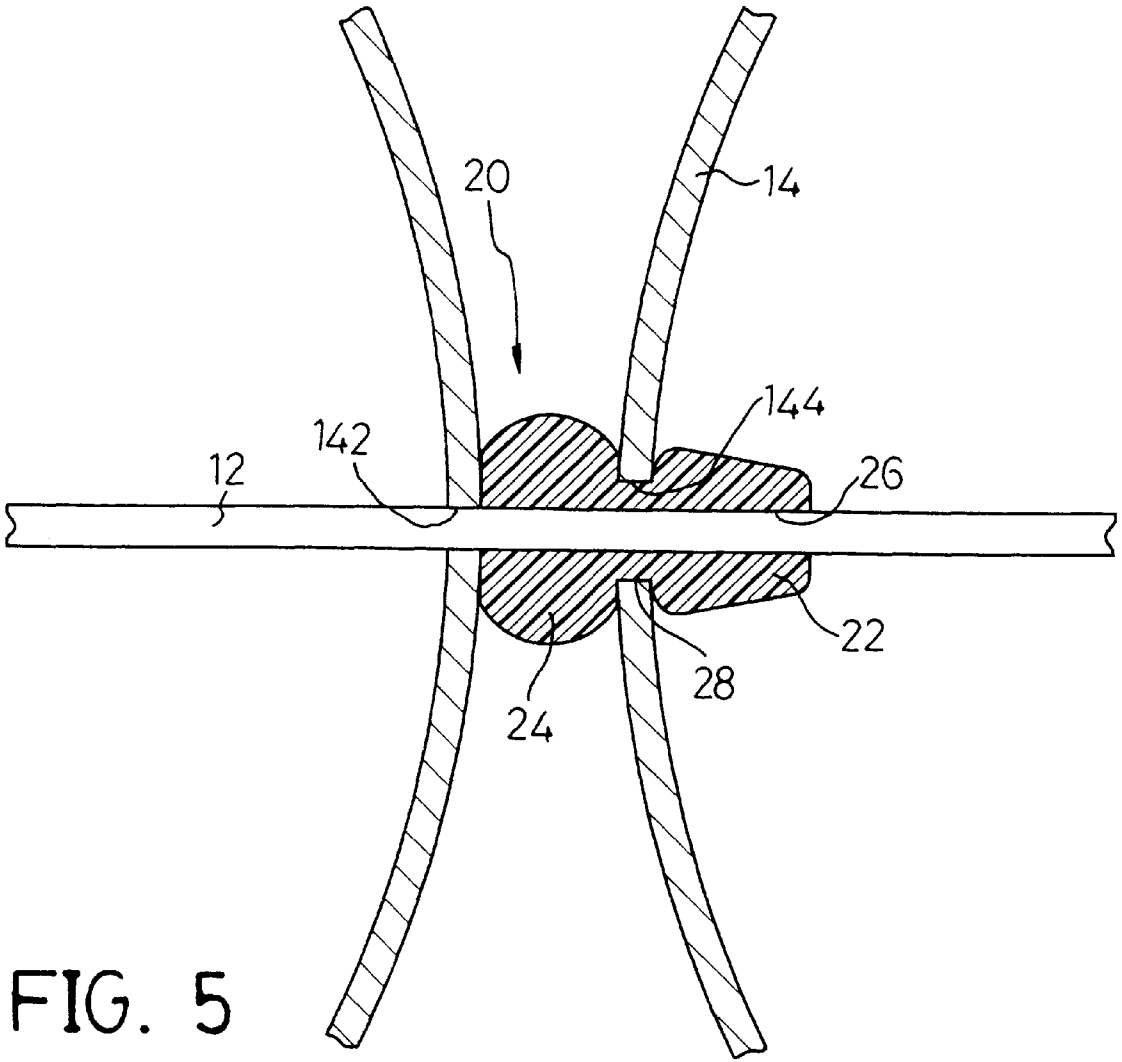
FIG. 5 is a cross-sectional view of a third embodiment showing the configuration of the plug between two balls of the exercise hoop in accordance with the present invention.
Figure 6:
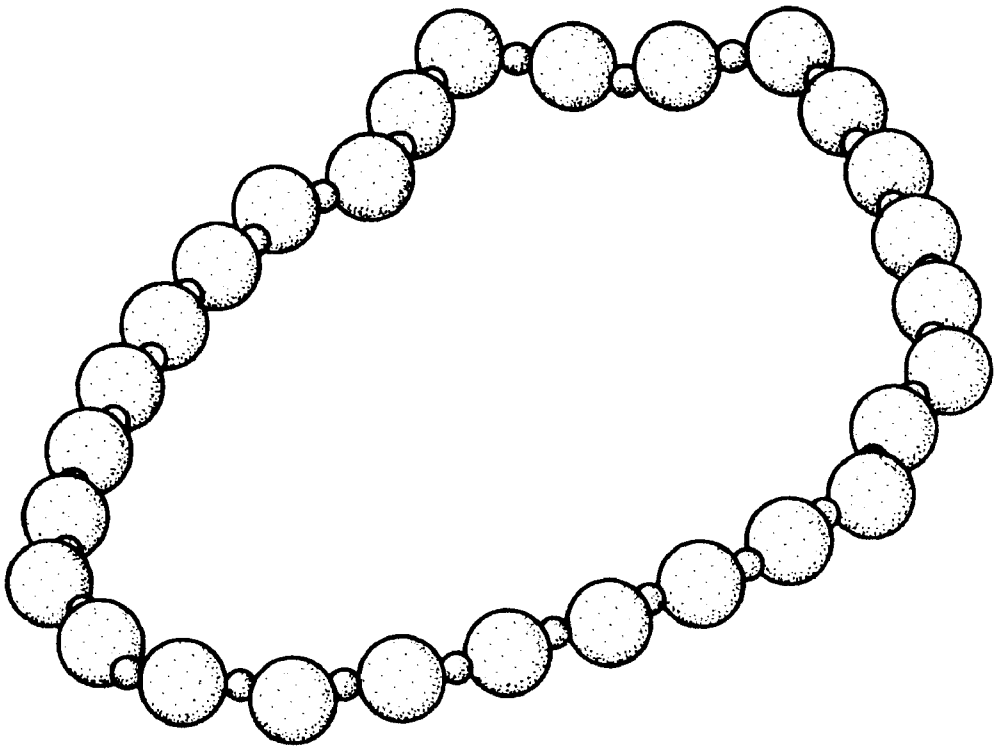
FIG. 6 PRIOR ART
FIG. 6 is a perspective view of a conventional exercise hoop.

Referring to FIG. 3, the plug (20) is made of a resilient material and includes a conical body (22), a head (24) formed on one end of the conical body (22), a bore (26) defined through the conical body (22) and the head (24) and a neck (28) formed integrally between the head (24) and the body (22). The maximum diameter of the body (22) is slightly larger than the diameter of the second opening (144) but the taper and resilience of the body (22) permit it to be intentionally but not accidentally deformed and then pushed into the ball (14) via the second opening (144). The neck (28) has an outer diameter substantially the same as the diameter of the second opening (144) and a length substantially the same as a wall thickness of the ball (14). The head (24) has an outer diameter too large to be deformed to enter the ball (14) via the second opening (144). The bore (26) has a diameter nominally larger than the diameter of the cord (12). As assembly of each ball (14) is the same, reference thereto is in singular hereinafter. First the ball (14) receives a fixed quantity of the pellets (16). Then a first end of the cord (12) is extended into the ball (14) via the first opening (142) and then out of the ball (14) via the second opening (144), after which it is extended through the bore (26) of the plug (20) such that the body (22) abuts the ball (14). Finally, the body (22) is urged into the ball (14) until the wall defining the second opening (144) mates with the neck (28) of the plug (20). The aforementioned procedure is repeated for all the balls (14) after which the ends of the cord (12) are tied together. In a first embodiment, as shown in FIG. 3, the head (24) of the plug (20) has a domed distal face. In a second embodiment. as shown in FIG. 4, the head (24) of the plug (20) has a flat distal face and a straight side wall. In a third embodiment, as shown in FIG. 5, the head (24) of the plug (20) is bulbous, and has a flat distal face.

The exercise hoop of the present invention permits differently weighted versions to be produced from a mold for a single-sized ball. That is, a specific quantity of pellets (16) is inserted in each ball (14) to achieve an overall weight is suitable for a beginner using the hoop. Another specific quantity of pellets (16) is inserted in each ball (14) to achieve an overall weight suitable for an experienced user of the hoop. A further specific quantity of pellets (16) is inserted in each ball (14) to achieve an overall weight suitable for an advanced user of the hoop, and so on.

When a user exercises with the hoop of the present invention, the pellets (16) will move in accordance with rotation of the hoop whereby both audible and physical rhythms will be generated which in turn provide novel and pleasant sensations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A weighted exercise hoop for rotation about a user's waist, comprising:

a plurality of hollow balls, each hollow ball containing a fixed quantity of pellets and having a first opening and a second opening diametrically opposite the first opening, each second opening having a diameter larger than the first opening;

a plurality of resilient plugs, each plug respectively corresponding to the second opening of one of the plurality of hollow balls and sealing the fixed quantity of pellets inside the respective hollow ball, each resilient plug comprising:

a head with a diameter larger than the diameter of the second opening;

a neck with a diameter substantially the same as the diameter of the second opening;

a conical body inserted into the second opening and pressed against a face of the ball; and a bore extending through the plug; and a cord extending through the bore of the plugs and the hollow balls, thereby linking the hollow balls and forming a hoop of contiguous hollow balls and plugs weighted by pellets, wherein rotation of the hoop about a user's waist provides audible and physical rhythms as the hoop rotates.

2. The weighted exercise hoop as claimed in claim 1, wherein the head has a domed distal face.

3. The weighted exercise hoop as claimed in claim 1, wherein the head of each resilient plug has a flat distal face.

4. The weighted exercise hoop as claimed in claim 1, wherein the head of each resilient plug is bulbous with a flat distal face.

* * * * *